US005203567A

United States Patent [19]

Erlinger et al.

[11] Patent Number: 5,203,567

[45] Date of Patent: Apr. 20, 1993

[54] GOLF PUTTING TRAINER

[75] Inventors: Michael D. Erlinger, Lawndale; Michael F. Abram, Palos Verdes Estates, both of Calif.

[73] Assignee: Connection Golf Corp., Redondo Bch, Calif.

[21] Appl. No.: 886,763

[22] Filed: May 20, 1992

[51] Int. Cl.[5] ..... A63B 69/36

[52] U.S. Cl. ..... 273/187.2; 273/189 R

[58] Field of Search ..... 273/187.2, 189 R, 189 A, 273/188 R, 188 A, 183.1, 187.6; 119/126, 127, 128

[56] References Cited

U.S. PATENT DOCUMENTS

| | | | |
|---|---|---|---|
| 1,655,092 | 1/1928 | Davis | 273/189 R |
| 3,106,718 | 10/1963 | Raab | 273/183 B |
| 3,109,244 | 11/1963 | Trifaro | 273/189 R X |
| 3,672,682 | 6/1972 | Yanigidaira | 273/189 R |
| 3,951,416 | 4/1976 | Koch et al. | 273/189 R |
| 4,045,033 | 8/1977 | Schuman | 273/188 R |
| 4,058,852 | 11/1977 | Aragona | 273/183 B X |
| 4,647,048 | 3/1987 | Welch | 273/188 A |
| 4,892,317 | 1/1990 | Corder | 273/183 B |
| 4,896,887 | 1/1990 | Cable | 273/189 R |
| 5,040,798 | 8/1991 | Leitao | 273/183 B |
| 5,048,836 | 10/1991 | Bellagamba | 273/188 R |
| 5,096,199 | 3/1992 | Wyatt et al. | 273/189 R |

*Primary Examiner*—George J. Marlo

*Attorney, Agent, or Firm*—Lawrence Cohen; Timothy Tyson

[57] ABSTRACT

Trainer embodiments (20, 120, 220) to aid a golfer in practicing a putting stroke are provided. The trainers define a pair of open concave surfaces (40, 42) supported in spaced coplanar relationship to encourage active participation of the golfer's arms and shoulders in the practice by requiring them to maintain the trainer in place. The trainer is configured to be spaced from the golfer's chest when in use. Structure for adjustment of the extent (56) of the spaced relationship and various locking structures therefor are provided.

14 Claims, 5 Drawing Sheets

GOLF PUTTING TRAINER

TECHNICAL FIELD

The present invention relates generally to sports apparatus and more particularly, to a trainer suitable for use by a golfer to actively participate in practicing a putting stroke.

BACKGROUND ART

Developing a consistent putting stroke is one of the more difficult goals for golfers who wish to improve their proficiency in the game of golf. It is generally considered that a consistent straight-back/straight-through putting stroke, in which the shoulders, arms and putter move as a single unit, is desirable. Training apparatus to aid the golfer in practicing such a stroke preferably encourages active participation of the golfer's muscles as part of the learning process.

DISCLOSURE OF INVENTION

The present invention is directed to training apparatus for use by a golfer in practicing a putting stroke.

Apparatus in accordance with the invention are characterized by a pair of members supported in a spaced relationship therebetween and each configured with an open concave surface to receive a golfer's arm. Such apparatus are further characterized by being configured to be spaced from the golfer's chest when in use. The open configuration of the concave surfaces is intended to encourage active participation of a golfer's muscles, when training with the apparatus, by requiring them to hold the trainer in place.

A preferred embodiment of the invention includes a shaft defined by one of the members to slidably receive a shaft defined by the other member to adjust the extent of the spaced relationship. In a preferred embodiment, the extent is locked by use of a lever and pawl defined on a resilient hinge portion of one of the shafts. The pawl is configured to be lifted by operation of the lever from any one of a sequence of apertures spaced along the other shaft. In another preferred embodiment, the extent is locked with a push button spring urged from one of the shafts into any one of a sequence of apertures in the other shaft. Indicia are spaced along one of the shafts to indicate the extent of the spaced relationship.

The novel features of the invention are set forth with particularity in the appended claims. The invention will be best understood from the following description when read in conjunction with the accompanying drawings.

MODES FOR CARRYING OUT THE INVENTION

Figure 1A:
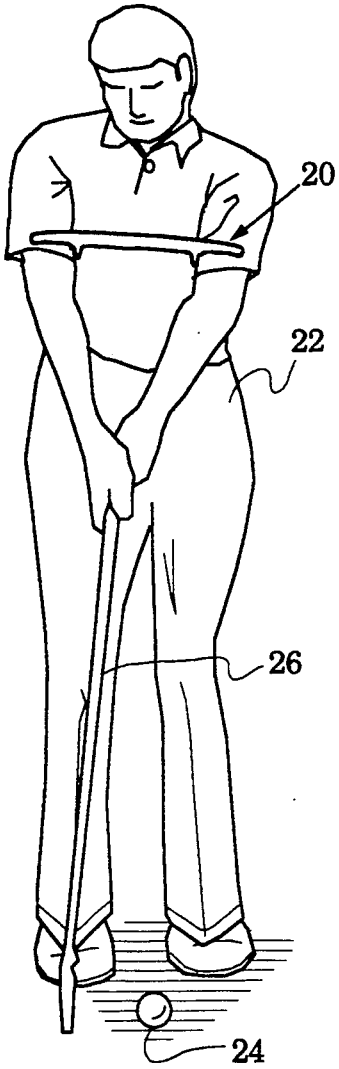
FIG. 1A is a perspective view of a putting trainer, a preferred embodiment in accordance with the present invention, in use by a golfer at one step of his putting stroke.
Figure 1B:
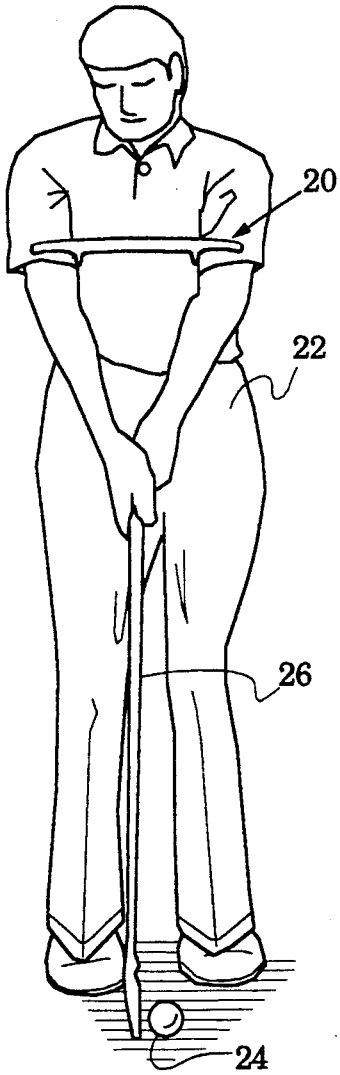
FIG. 1B is a view similar to FIG. 1A illustrating a successive step of the golfer's putting stroke.
Figure 1C:
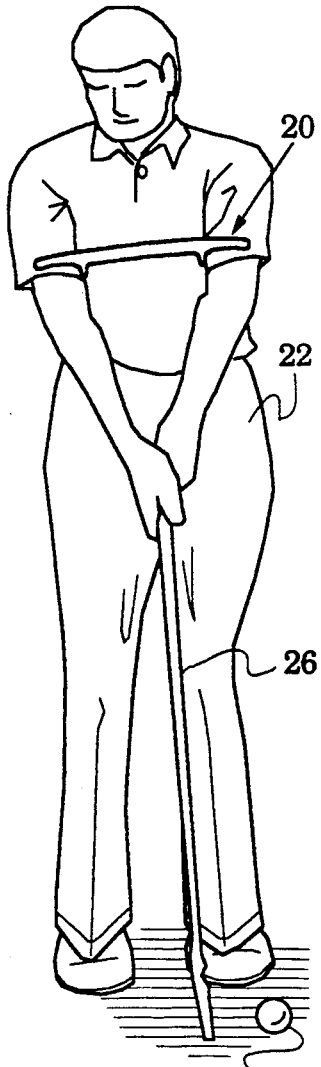
FIG. 1C is a view similar to FIG. 1B illustrating a successive step of the golfer's putting stroke.

A preferred golf putting trainer embodiment 20, in accordance with the present invention, is shown in use by a golfer 22 in FIGS. 1A, 1B and 1C which illustrate successive steps in putting a golf ball 24 with a putter 26. Top plan and front elevation views of the trainer 20 are respectively shown in FIGS. 2 and 3.

The trainer 20 defines open concave surfaces that each receive one of the arms of the golfer 22. The surfaces are spaced to hold the arms in a desired relationship but since they are open (i.e. not closed as in a circle) the golfer is encouraged to actively participate in practicing the putting stroke, i.e. the muscles of the arms and shoulders actively cooperate to hold the trainer 20 in place during the stroke.

Thus, the arm and shoulder muscles are trained to coordinate their movements in a manner that will be beneficial when putting without the trainer 20. The trainer 20 avoids applying a restraint or restriction to the golfer's arms as would be the case, for example, with closed loops that encircle the arms because restriction generally discourages active participation by the golfer's body. In addition, the portions of the trainer 20 which support and space the concave surfaces is configured to be spaced away from the golfer's chest to avoid interference therewith during practice of the putting stroke.

The trainer 20 forms a simple lightweight apparatus which avoids contact with a golfer's body while training the arm and shoulder muscles to actively participate in a consistent straight-back/straight-through putting stroke in which the arms, shoulders and putter act as a unit and resemble the motion of a pendulum as illustrated in FIGS. 1A, 1B and 1C.

Figure 3:
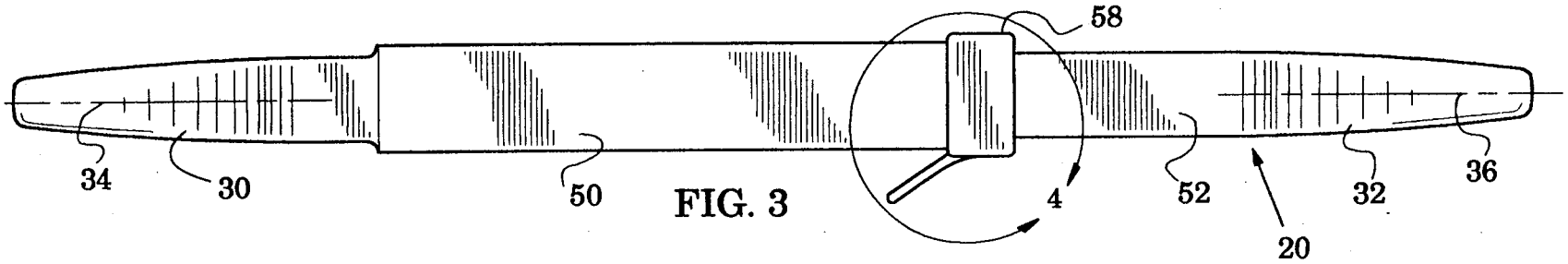
FIG. 3 is an front elevation view of the trainer of FIG. 1A.
Figure 2:
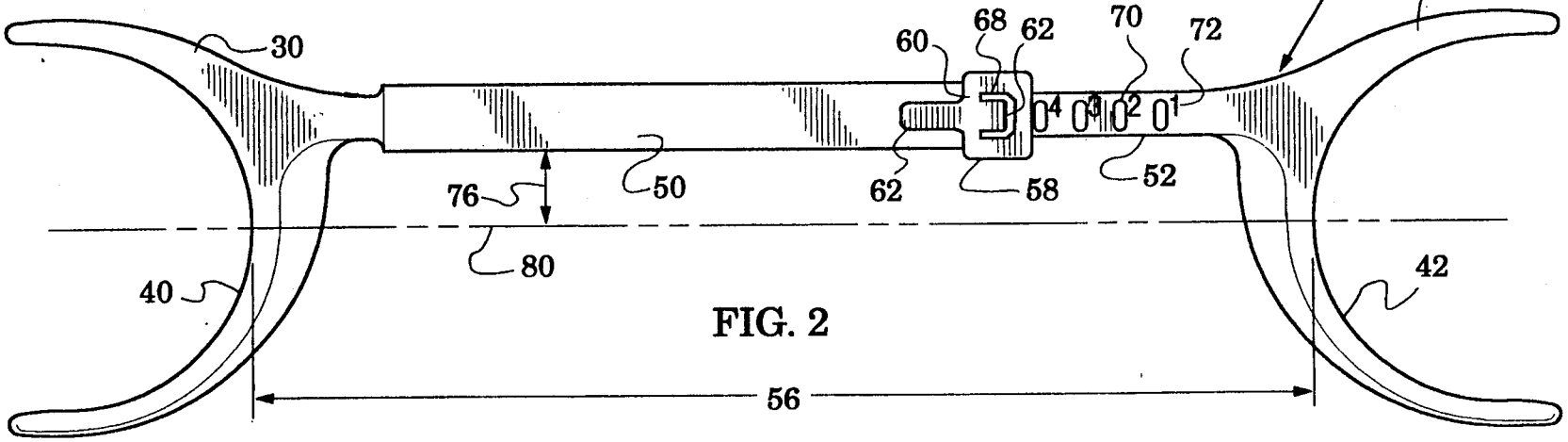
FIG. 2 is a top plan view of the trainer of FIG. 1A.

In detail, the trainer 20, as shown in FIGS. 2 and 3, has a pair of members 30, 32 which respectively define along first planes 34, 36, an open concave surface 40, 42 each configured to receive a different one of a golfer's arms as in FIGS. 1A, 1B and 1C. The members 30, 32 respectively define a shaft 50, 52 wherein the shaft 50 further defines an elongated passage 54 to slidably receive the shaft 52. The passage 54 is indicated in FIG. 4A which is an enlarged sectional view of the area within the line 4 of FIG. 3.

The shaft 52 slides within the shaft 50 to facilitate setting the extent 56 (shown in FIG. 2) of the spaced relationship between the concave surfaces 40, 42 to the needs of each user of the trainer 20. The shafts 50, 52 are configured to support each of the concave surfaces 30, 32 in a coplanar (i.e. planes 34, 36 are coplanar) relationship.

Figure 4B:
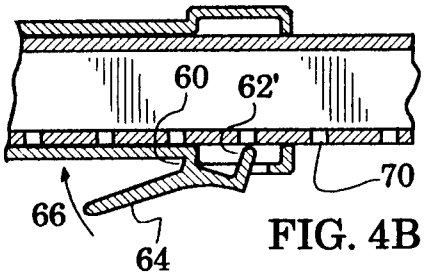
FIG. 4B is a view similar to FIG. 4A showing an alternate position of the locking structure.
Figure 4A:
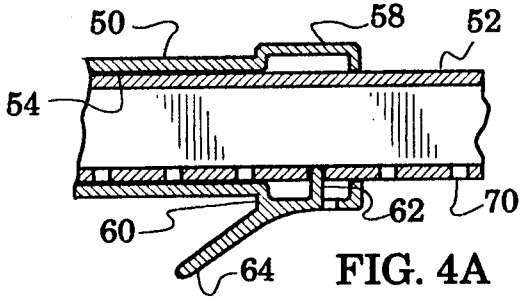
FIG. 4A is an enlarged sectional view of the area within the line 4 of FIG. 3 illustrating the locking structure of the trainer of FIG. 1A.

As further shown in FIG. 4A, the shaft 50 terminates in a circumferential boss 58 having a reduced resilient hinge portion 60 (the shafts 50, 52 are preferably fabricated from a polymer such as polyethylene) and further defines, extending from the resilient hinge portion 60, a pawl 62 and a lever 64. The resilient hinge portion 60 is formed with the aid of a U shaped cut 68 in the boss 58. FIG. 4B illustrates that the pawl 62 is configured to be lifted, by operation of the lever 64 in the direction 66, to a position 62'' from any one of a sequence of apertures 70 defined by the shaft 52 and spaced therealong. When the lever 64 is released the pawl 62 may engage one of the apertures 70 as shown in FIG. 4A to lock the extent 56 of the spaced relationship between the surfaces 40, 42.

Indicia 72 are disposed on the shaft 52 (e.g. by application of decals, by application of paint, by molded definition in the shaft) to identify, in cooperation with the end of the shaft 50, the extent 56 of the spaced relationship between the surfaces 40, 42. By use of the indicia 72 a golfer can adjust the trainer 20 to the spaced relationship most suitable for his or her use. Also, more than one golfer may use the same trainer since each can adjust the trainer to a predetermined setting as indicated by the indicia 72.

The members 30, 32 define the shafts 50, 52 so that they are spaced, as indicated by the arrow 76, from a second plane 80 that is normal to the first planes 34, 36 and which bisects the concave surfaces 40, 42. Thus, the trainer 20, with each concave surface 30, 32 receiving one of the arms of a golfer 22 can be positioned with the shafts 50, 52 spaced from the golfer's chest, as shown in FIGS. 1A, 1B and 1C, to avoid interference therewith as the arms and shoulders are swung back and forth in putting stroke practice.

Figure 6A:
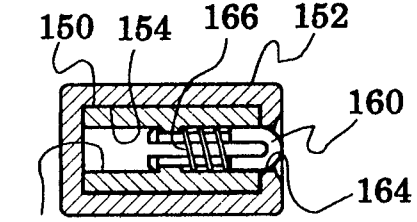
FIG. 6A is an enlarged view along the plane 6—6 of FIG. 5.
Figure 6B:
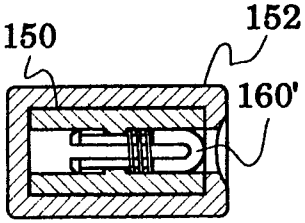
FIG. 6B is a view similar to FIG. 6A.
Figure 5:
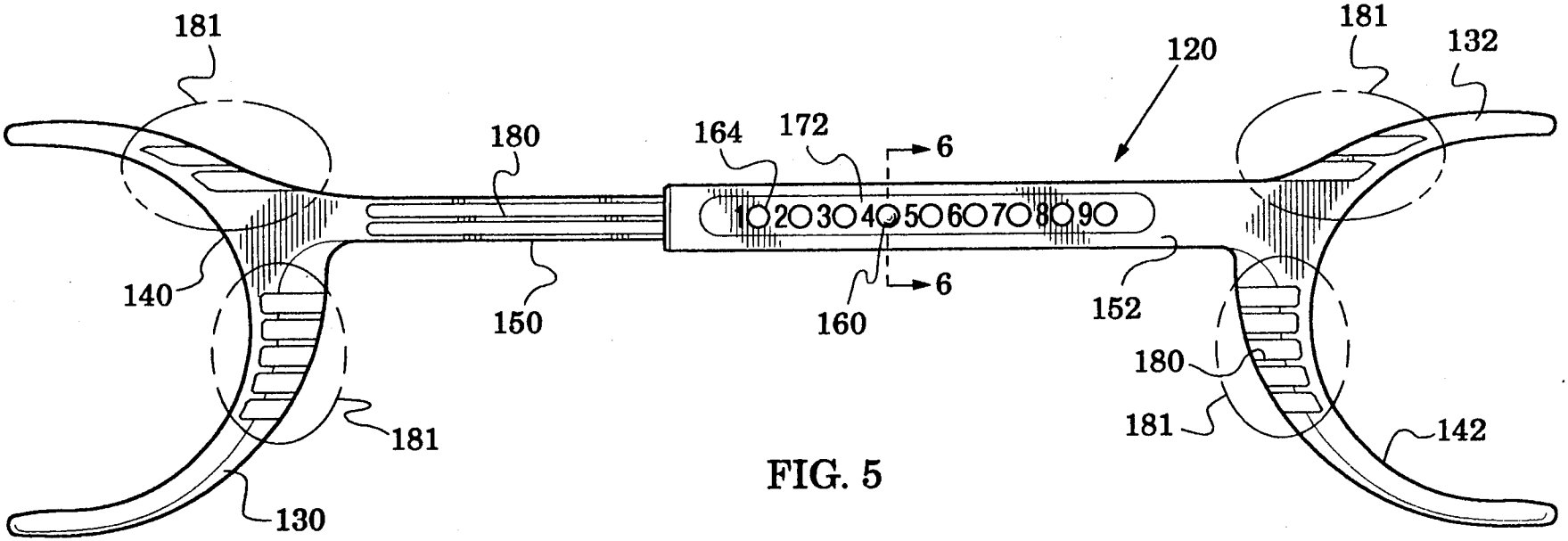
FIG. 5 is a view similar to FIG. 2 illustrating another preferred trainer embodiment.

Another preferred trainer embodiment 120 is illustrated in FIG. 5. The trainer 120 has members 130, 132 that respectively define open concave surfaces 140, 142 and shafts 150, 152. As seen in FIG. 6A, which is an enlarged view along the plane 6—6 of FIG. 5, the shaft 152 defines an elongated passage 154 to slidably receive the shaft 150. To lock the extent of the spaced relationship between concave surfaces 140, 142, a push button 160 protrudes from a bore 162 defined in the shaft 150 into one of a sequence of apertures in the form of holes 164 defined in, and spaced along, the shaft 152. The push button 160 can be pressed against the urging of a spring 166 to the position 160' illustrated in FIG. 6B, a view similar to FIG. 6A, where the push button 160 clears the shaft 152 permitting the shaft 150 to slide within the shaft 152.

Figure 7:
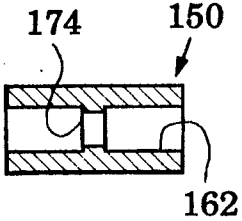
FIG. 7 is a view of one of the shafts of FIG. 6A.
Figure 8:
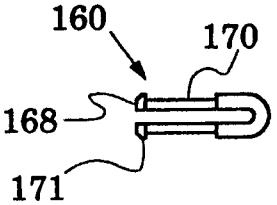
FIG. 8 is an elevation view of the push button of FIG. 6A.

As seen in the enlarged plan view of FIG. 8, the push button 160 defines a pair of resilient legs 168 each having a reduced section 170 to receive the spring 166. To retain the push button 160 within the shaft 150, a tab 171 at the end of each leg 168 engages an annular rib 174 defined by the shaft 150 within its bore 162 (illustrated in the enlarged sectional view of FIG. 7). Each tab 171 is chamfered to allow initial installation with the spring 166 in the passage 162.

FIG. 5 shows indicia 172 in the form of numbers disposed adjacent the spaced holes 164. The push button 160 visibly protrudes through a selected one of the holes 164 (e.g. the hole bearing the number 4 in FIG. 5) to identify, via the adjacent number, the extent of the spaced relationship between concave surfaces 140, 142. A user of the trainer 120 can change the extent of the spaced relationship between concave surfaces 140, 142 by pressing down on the push button 160 and sliding the shaft 150 within the shaft 152 until the push button 160 snaps into the next hole 164.

The trainers 20 (of FIG. 2) and 120 are especially suited for fabrication from resilient polymers. As shown in FIG. 5, this feature may be used to remove material to define ribs 180 for reducing mass (for clarity of illustration the ribs are shown only on part of the members 130, 132 in addition to shaft 150; the ribs may extend over all of the members 130, 132 and along shaft 152). Additionally, when the ribs 180 are oriented parallel to the plane 80 of FIG. 2, as they are in FIG. 5, they function as a visual guide for the golfer to use in aligning his putting stroke during practice.

Figure 9:
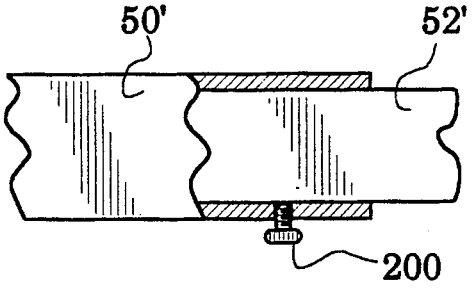
FIG. 9 is a partially sectioned view similar to FIG. 4A illustrating another preferred locking structure embodiment.
Figure 10:
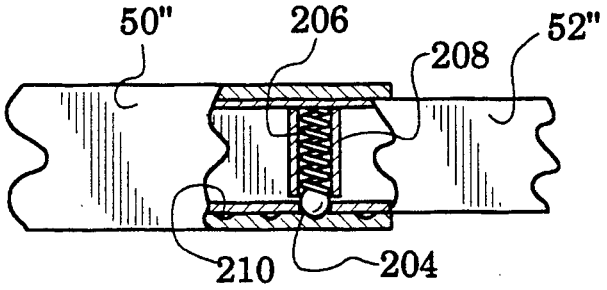
FIG. 10 is a partially sectioned view similar to FIG. 4A illustrating another preferred locking structure embodiment.
Figure 11:
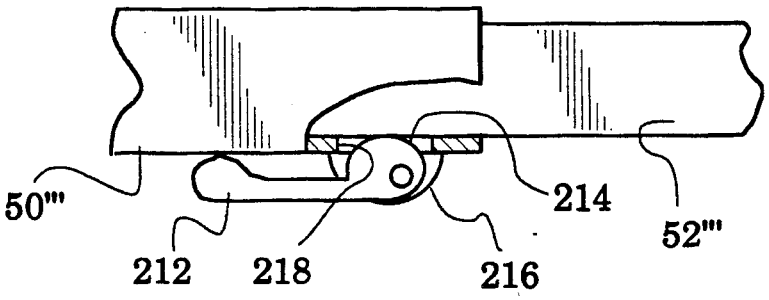
FIG. 11 is a partially sectioned view similar to FIG. 4A illustrating another preferred locking structure embodiment.

FIGS. 9, 10 and 11 are views similar to FIG. 4A illustrating other preferred embodiments for locking the extent 56 of the spaced relationship between the surfaces 40, 42. In FIG. 9, a set screw 200 is threadably mounted in a shaft 50' to abut a shaft 52'. In FIG. 10 a ball 204 is urged by a spring 206 restrained in a housing 208 formed within a shaft 52'' to be received in one of a plurality of indentations 210 in a shaft 50''. In FIG. 11 a lever 212 defining a cam 214 is rotatably mounted in a boss 216 defined by a shaft 50'''. When swung to the position shown, the cam 214 protrudes through a slot 218 in the shaft 50''' to abut a shaft 52'''.

Figure 12:
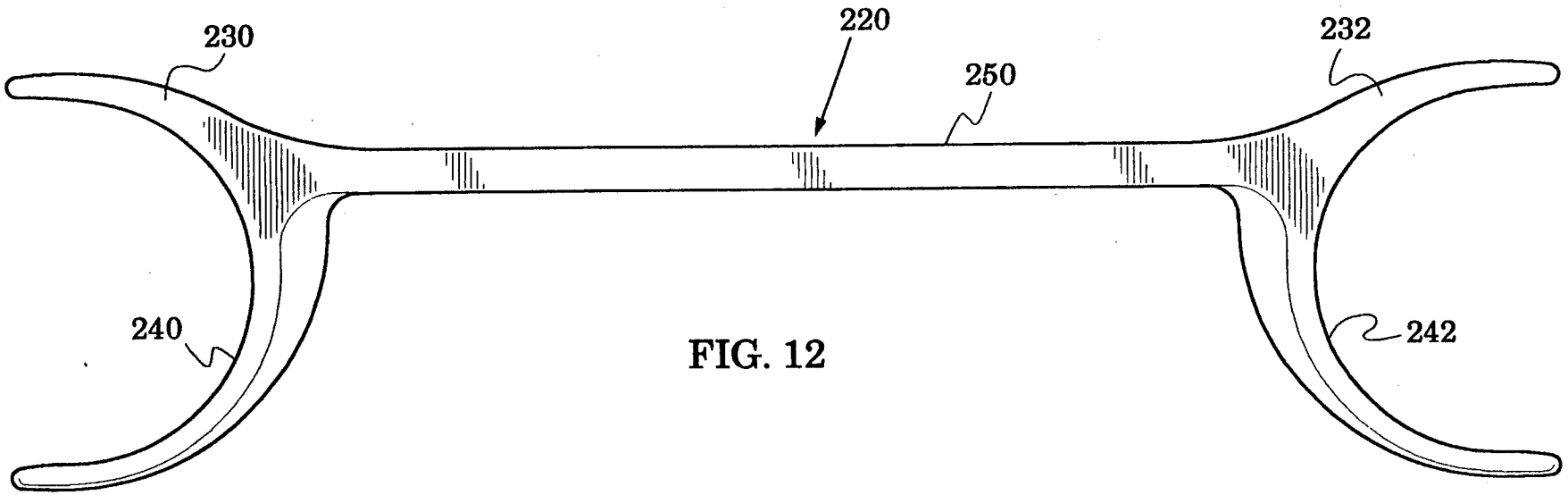
FIG. 12 is a view similar to FIG. 2 illustrating another preferred trainer embodiment.

FIG. 12 is a view similar to FIG. 2 illustrating a trainer 220 in which the members 230, 232 respectively define open concave surfaces 240, 242 and a shaft 250 which supports the concave surfaces in a spaced coplanar relationship. Thus the trainer 220 is similar to the trainers 20, 120 but with the extent of the spaced relationship permanently set.

From the foregoing it should now be recognized that putting trainer embodiments have been disclosed herein which encourage, through the use of open concave surfaces arranged in a spaced coplanar relationship, active participation of a user thereof in practicing a putting stroke. The trainer is configured to be spaced from a user's chest to avoid interference therewith during practice. The trainer is especially suitable for economical fabrication from a resilient polymer.

Although the present invention has been described with reference to preferred embodiments, numerous modifications and rearrangements can be made with the equivalent result still embraced within the scope of the invention.

What is claimed is:

1. A golf putting trainer encouraging active participation of a user thereof, comprising:

a pair of members, each defining, along a first plane thereof, an open concave surface defining an opening through which a user's arm can be received; and means for supporting said members with each concave surface and the opening thereto facing away from the other in a coplanar spaced relationship with said supporting means spaced from a second plane normal to each first plane and bisecting each concave surface;

each concave surface thus arranged to receive a different one of a user's arms to hold said putting trainer therebetween for active participation of the user in practicing a putting stroke with said supporting means spaced from the user's chest to avoid interference therewith.

2. The trainer of claim 1 wherein said supporting means comprises a shaft defined by said members to join said members and said shaft together in an integral whole.

3. The trainer of claim 1 wherein said supporting means comprises:

a first elongated shaft defined by one of said members;

a second elongated shaft defined by the other of said members, said second shaft defining an elongated passage for slidably receiving said first shaft to adjust the extent of said spaced relationship; and means for locking said first shaft and said second shaft together to set said extent.

4. The trainer of claim 3 wherein said putting aid further comprises indicia spaced along said first shaft, said indicia cooperative with the end of said second shaft to indicate to a user of said trainer the magnitude of said extent.

5. The trainer of claim 3 wherein said locking means comprises:

said first shaft defining spaced apertures;

a resilient hinge portion defined by said second shaft;

a pawl defined by said second shaft to extend from said hinge portion into any selected one of said apertures to lock said first and second shafts together; and a lever defined by said second shaft to extend from said hinge portion;

said lever providing leverage to urge said pawl from any of said holes for adjusting said extent.

6. The trainer of claim 3 wherein said locking means comprises:

said second shaft defining spaced apertures;

a push button slidably arranged in said first shaft to protrude into any selected one of said apertures; and a spring to retain said push button in any selected one of said apertures.

7. The trainer of claim 6 wherein said putting aid further comprises indicia disposed adjacent said apertures to indicate to a user of said trainer the magnitude of said extent.

8. The trainer of claim 3 wherein said locking means comprises a set screw rotatably mounted in said second shaft for abutting said first shaft.

9. The trainer of claim 3 wherein said locking means comprises:

a cam rotatably mounted on said second shaft; and a lever attached to said cam for rotatably urging said cam to abut said first shaft.

10. The trainer of claim 3 wherein said locking means comprises:

said first shaft defining a plurality of indentations;

a ball; and spring means, mounted in said second shaft, for urging said ball into one of said indentations.

11. The trainer of claim 3 wherein each of said members define ribs oriented parallel to said second plane to provide a visual alignment guide for a user of said trainer when practicing a putting stroke therewith.

12. The trainer of claim 3 wherein said first and second shaft each define ribs oriented parallel to said second plane to provide a visual alignment guide for a user of said trainer when practicing a putting stroke therewith.

13. A method of practicing a putting stroke which encourages active participation of a golfer, the method comprising the steps of:

defining, in each of a pair of members, an open concave surface, each of said surfaces defining an opening through which one of the user's arms is received, the openings facing away from each other;

providing a shaft to support said members with each concave surface substantially aligned in a first plane and facing away from the other in a spaced relationship and with said shaft spaced from a second plane normal to said first plane and bisecting each concave surface;

abutting with each arm a different one of said concave surfaces with said shaft spaced from the chest; and practicing putting strokes with pressure exerted on each concave surface by the arms to maintain said trainer therebetween.

14. The method of claim 13 wherein said providing step comprises the step of configuring said shaft in slidable parts to adjust the extent of said spaced relationship.

* * * * *